United States Patent [19]

Kollberg

[11] Patent Number: 4,562,881

[45] Date of Patent: Jan. 7, 1986

[54] METHOD FOR STIRRING IN CONTINUOUS CASTING

[75] Inventor: Sten Kollberg, Västerås, Sweden

[73] Assignee: ASEA Aktiebolag, Västerås, Sweden

[21] Appl. No.: 434,736

[22] Filed: Oct. 18, 1982

Related U.S. Application Data

[63] Continuation-in-part of Ser. No. 204,530, Nov. 6, 1980, abandoned.

[51] Int. Cl.[4] ..... B22D 11/10; B22D 27/02

[52] U.S. Cl. ..... 164/468; 164/504

[58] Field of Search ..... 164/468, 504, 147.1, 164/499

[56] References Cited

U.S. PATENT DOCUMENTS 4,030,534 6/1977 Ito et al. ..... 164/468

4,040,467 8/1977 Alberny et al. ..... 164/468

FOREIGN PATENT DOCUMENTS 503634 3/1976 U.S.S.R. ..... 164/504

*Primary Examiner*—Nicholas P. Godici
*Assistant Examiner*—Richard K. Seidel
*Attorney, Agent, or Firm*—Kenyon & Kenyon

[57] ABSTRACT

A method for stirring the unsolidified metal in the cast strand in continuous casting uses an asymmetrical multiphase stirring current with asymmetry caused by the phase angle of one phase of the current deviating from the phase angle of another phase of the current. In addition to the asymmetrical stirring, symmetrical stirring can be used at a location adjacent to the asymmetrical stirring so that the benefits of both types of stirring are obtained.

4 Claims, 5 Drawing Figures

METHOD FOR STIRRING IN CONTINUOUS CASTING

This is a continuation-in-part application of Ser. No. 204,530, filed Nov. 6, 1980, now abandoned.

For the continuous casting of metal, molten metal is continuously tapped into the top of a cooled continuous casting mold where the metal solidifies first at its surface to form a skin and then a cast strand continuously traveling from the mold with the solidified skin containing unsolidified molten metal until complete solidification occurs. If allowed to completely solidify statically, the strand contains undesirable segregations.

However, one or more straight electromagnetic stirrers can be stationarily positioned opposite to the traveling strand containing the unsolidified metal, such as steel, the stirrer having multi-phase windings or coils supplied with multi-phase current so as to induce a traveling multi-phase current in the molten metal with consequent stirring of the molten metal.

Such a stirrer has its phase windings or phase coils and pole pieces positioned in a linear arrangement. The phase windings or coils have the same number of ampere turns for each phase, and the stirrer is supplied with symmetrical multi-phase current.

The traveling field induced in the molten metal causes stirring which is intended to prevent the formation of segregations which would otherwise remain in the completely solidified strand.

Such conventional stirring can cause the molten metal to be put in motion too abruptly when too violent stirring is involved. In the case of steel, the dendrites which form during solidification with concentrations of sulfur and carbon between the dendrites, involve the problem that these concentrations are spread into the molten steel so as to cause the so-called white bands to form and which when the fully solidified steel strand is rolled to the final product desired, cause objectionable defects.

The above problem can be reduced in severity by replacing the symmetrical stirring with current-asymmetrical stirring. For this the current strength of one phase of the multi-phase current is made to deviate by at least 10% from the phase current in another phase, thus powering a symmetrical stirrer asymmetrically so that asymmetric stirring currents are induced in the molten metal. The same result can be achieved by the use of the usual symmetrical multi-phase current by using a special multi-phase stirrer wherein the phase windings or coils are made to differ in ampere turns, one from another, so that the multi-phase current induced in the molten metal inside of the strand skin, is asymmetrical. With such asymmetrical stirring, the molten metal becomes turbulent and its viscosity is reduced. With symmetrical stirring the molten metal flow is more laminar but is more extended.

A straight stirrer may be positioned either transversely or longitudinally with respect to the traveling continuously cast strand containing the molten metal, and the current frequency may vary. Usually in the case of a strand having a slab cross-section where the width is much greater than the thickness, the straight electromagnetic stirrer is positioned transversely and a frequency of not more than 10 Hz is used. In the case of a bloom cross-section where the thickness and width are more nearly the same or are the same, a frequency of from 10 to 30 Hz can be used, whereas in the case of the smaller-sized billet cross-section, the frequency may range from 50 to 60 Hz. In the latter two instances, the straight stirrer is usually positioned longitudinally with respect to the strand.

Another way to solve the previously described problem is to induce in the molten metal a phase-asymmetrical current having the phase angle of one phase deviating from that of the phase angle of another phase. In the case of a two-phase current, the phase angle is 90°, and in the case of a three-phase current, it is 120°, and in either case the phase angle or displacement of one of the phases should deviate from that of another, preferably for about 5°. Such phase-asymmetrical current stirring also causes turbulence.

Current-asymmetrical stirring is disclosed by U.S. application Ser. No. 27,391, filed Apr. 5, 1979 by the present applicant and others. The above-disclosed phase-asymmetrical current stirring has been invented by the present applicant with the object of providing for fuller utilization of the electromagnetic stirrer windings or coils than is possible in the case of current-asymmetrical stirring.

With the asymmetrical current stirring the electromagnetic stirrer windings or coils and cores may not be fully utilized. This possible disadvantage can be overcome by combining the usual symmetrical stirring with the asymmetrical-phase current stirring.

With the above combination, the symmetrical stirring provides its usual motoric stirring or thrust on the molten metal to which the asymmetrical stirring adds turbulence to the molten metal which reduces the molten metal's viscosity with consequent more effective overall stirring action.

To further improve the structure of the strand cast by the continuous casting mold, using at least two stirrers, with one stirrer providing asymmetrical stirring and the second stirrer providing symmetrical stirring, the phase number of the current of both stirrers should be the same. Both should be either twophase or three-phase, for example.

For a more detailed understanding of the foregoing principles, reference may be had to the accompanying schematic drawings, in which.

Figure 4:
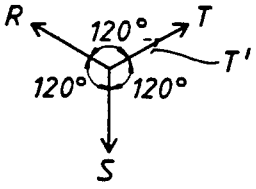
FIG. 4 shows the current vectors for symmetrical and current-asymmetrical three-phase current.

Referring first to FIG. 4, it shows the current vectors for a symmetrical three-phase current R, S and T, and by changing to current asymmetry, the vectors R, S and T', the current deviation being in the phase T and being at least 10% deviation as indicated at T'. Such a current, when supplied to a three-phase stirrer, induces a corresponding asymmetrical current in the molten metal in a continuously cast strand, producing turbulence in the molten metal. It can be seen that the electromagnetic stirrer winding or coil normally carrying the phase T is not utilized nearly so fully as in the case of phases R and S, because the phase current T must be reduced as shown by T'.

Figure 5:
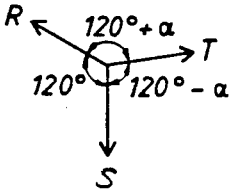
FIG. 5 is a phase-asymmetrical current vector diagram.

Contrastingly, FIG. 5 shows a phase-asymmetrical current vector diagram with vectors R, S and T with the mutual phase angles partially deviating or displaced from 120°, by at least 5°. As shown, the normal 120° angle between the phase R and phase T is increased by the phase angle displacement $\alpha$ and is correspondingly decreased by $\alpha$ between the phases T and S. Supplied to a three-phase stirrer, this type of current also induces asymmetrical currents in the molten metal in a continuously cast strand. In this case, as shown by the vectors, the phase windings or coils are utilized to a much fuller extent than in the case of current asymmetry.

Combinations of current-asymmetrical and phase-symmetrical currents may be used to asymmetrically stir the strand's molten metal and the multi-phase stirrer may have symmetrically or asymmetrically wound windings or coils.

Electromagnetic stirrers are conventionally powered via a thyristor converter permitting control of both phase current strength and phase angle. For example, the described phase displacement can be effected by delaying triggering of one of the current-feeding thyristors.

Figure 1:
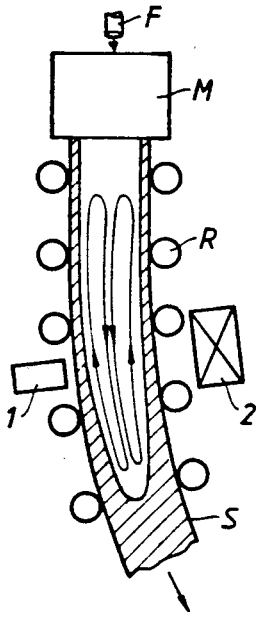
FIG. 1 shows the continuous casting of a strand having a slab cross-section.
Figure 2:
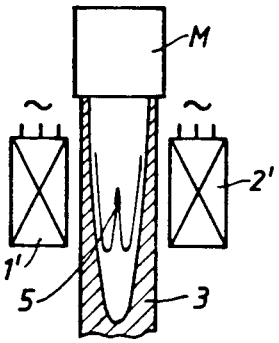
FIG. 2 is like FIG. 1 but shows an embodiment where a strand of bloom cross-section is cast.
Figure 3:
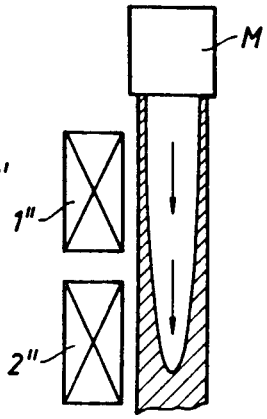
FIG. 3 is again the same but involves the casting of a strand of billet cross-section.

Practical arrangements for practicing the foregoing concepts are illustrated by FIGS. 1 to 3.

In FIG. 1 a continuous casting mold M is being fed via its top with molten steel, for example, via a feed F, the continuously cast strand S traveling from the bottom of the mold and its skin supported by the usual skin support and strand guiding rollers R.

It is to be assumed that the strand S is of slab cross-section and is being viewed edgewise in FIG. 1. On the left-hand side, a transverse straight electromagnetic stirrer 1 is shown, while on the right-hand side another such stirrer is shown, but in this cas longitudinally aligned with the strand. Any of the rollers R between the electromagnetic stirrer 2 and the strand can be made of non-magnetic metal. The stirrer 1 can stir asymmetrically, via either the previously described phase-asymmetrical stirring or current-asymmetrical stirring. The stirrer 2 is a symmetrical stirrer and functions in the conventional way so as to provide the major thrust or drive on the molten metal. The asymmetrical stirrer 1 produces turbulence in the molten metal reducing its viscosity. With the two types of stirring, a more perfect structure is obtained in the completely solidified strand. Normally, the symmetrical stirrer should be fed with greater power than is the asymmetrical stirrer.

It is possible for the stirrer 2 to also stir symmetrically providing the asymmetry is of different type than that provided by the stirrer 1. Preferably the stirrer 2 is a symmetrical stirrer.

For maximum stirring and more positive elimination of segregations or white bands in the finely solidified strand, both stirrers 1 and 2 should be powered with current having the same number of phases. In other words, both should be either two-phase or three-phase. Further, when the stirrer 1 is a phase-asymmetrical stirrer, wherein the phase angle of one phase differs from that of another phase by at least 5°, any possible loss of stirring efficiency is corrected by the use of the stirrer 2 when the latter provides symmetrical stirring.

FIG. 2 involves the same general principles but shows that the stirrers 1' and 2' may be positioned not only opposite to each other, but longitudinally with respect to the strand 3, the melt flow being shown at 5. In this case the strand being a bloom cross section, may not require the skin support rollers R of FIG. 1.

FIG. 3 shows that in the case of the strand having a billet cross-section, the two stirrers 1'' and 2'' can be positioned in series although adjacent to each other.

I claim:

1. A method of asymmetrically stirring in continuous casting, said method comprising tapping molten metal into a continuous casting mold having an open bottom so as to produce a molded casting strand traveling from said bottom, the said strand gradually solidifying first at its surface so as to form a skin containing non-solidified metal, and stirring the non-solidified metal in said strand by a multi-phase electromagnetic stirrer positioned opposite to the strand below said mold, by supplying the stirrer with multi-phase stirring current having the phase angle of one of its phases differing from the phase angle of another of its phases by at least 5° so as to induce asymmetrical stirring currents in said non-solidified metal.

2. The method of claim 1 in which the current strength is substantially the same in all phases of said stirring current.

3. The method of claim 2 in which said unsolidified part is stirred with a symmetrical multi-phase stirring current and also with said asymmetrical stirring current.

4. A method of stirring in continuous casting, said method comprising tapping molten metal into a continuous casting mold having an open bottom so as to produce a molded casting strand traveling from said bottom, the said strand gradually solidifying first at its surface so as to form a skin containing non-solidified metal, and stirring the non-solidified part of said strand by a multi-phase electromagnetic stirrer below said mold, said stirrer being fed with multi-phase current, the current in at least one phase having a phase angle at least 5° different from the phase symmetrical position, at least one of the other phase currents being in phase symmetrical position, thus stirring said part with an asymmetrical multi-phase stirring current.

* * * * *